US009273927B2

(12) United States Patent
Bondhus et al.

(10) Patent No.: US 9,273,927 B2
(45) Date of Patent: Mar. 1, 2016

(54) COLLAPSIBLE PISTOL

(71) Applicant: Bondhus Arms, Inc., Big Lake, MN (US)

(72) Inventors: Carl Eric Bondhus, Monticello, MN (US); Eric George Bondhus, Big Lake, MN (US)

(73) Assignee: Bondhus Arms, Inc., Big Lake, MN (US)

( * ) Notice: Subject to any disclaimer, the term of this patent is extended or adjusted under 35 U.S.C. 154(b) by 0 days.

(21) Appl. No.: 14/612,274

(22) Filed: Feb. 2, 2015

(65) Prior Publication Data

US 2015/0219419 A1 Aug. 6, 2015

Related U.S. Application Data

(60) Provisional application No. 61/934,054, filed on Jan. 31, 2014.

(51) Int. Cl.
*F41A 3/00* (2006.01)
*F41C 3/00* (2006.01)

(52) U.S. Cl.
CPC ..... *F41C 3/00* (2013.01)

(58) Field of Classification Search
CPC ..... F41C 9/00; F41C 9/02
USPC ..... 42/1.09, 69.01, 1.16, 2, 59, 8, 52
See application file for complete search history.

(56) References Cited

U.S. PATENT DOCUMENTS

| | | | | |
|---|---|---|---|---|
| 4,299,046 | A * | 11/1981 | Atchisson | 42/75.04 |
| 6,234,058 | B1 * | 5/2001 | Morgado | 89/33.03 |
| 7,739,821 | B1 * | 6/2010 | Hamme | 42/8 |
| 7,941,954 | B2 * | 5/2011 | Carr et al. | 42/36 |
| 8,051,594 | B2 * | 11/2011 | Carr et al. | 42/73 |
| 8,196,328 | B2 * | 6/2012 | Simpkins | 42/73 |
| 9,021,734 | B2 * | 5/2015 | Voigt | 42/75.04 |

* cited by examiner

*Primary Examiner* — Reginald Tillman, Jr.
(74) *Attorney, Agent, or Firm* — Wood, Herron & Evans, LLP

(57) ABSTRACT

A folding pistol is balanced so that it is held making three points of contact with the user's hand, resulting in more stability when discharged. When held by a user, the invention puts the gun bore axis in close alignment to the center axis of the user's forearm; reducing barrel jump and improving accuracy. A folding rear activation arm when in the closed position mechanically blocks the hammers preventing unintentional discharge.

6 Claims, 16 Drawing Sheets

50
94
92
18
12
20
78
90
84
76
72
98
74
62
58
52
60
108
68
104
106
96
70
110
100
102

COLLAPSIBLE PISTOL

CROSS-REFERENCE TO RELATED APPLICATION

This application claims the benefit of U.S. Provisional Patent Application No. 61/934,054, filed Jan. 31, 2014.

TECHNICAL FIELD

The present invention is in the technical field of firearms; more particularly a personal defense handgun that is foldable and easily concealable.

BACKGROUND OF THE INVENTION

Conventional compact handguns do not collapse and may be hard to carry concealed on a person's body because of their larger size. In many cases, the only safeties these pistols have are a heavier pull trigger. The very small compact handguns that use center fire ammunition, which is more effective for self defense, can be difficult to control during shooting because of their small hand grip size, heavy pull triggers, and the typical above-center barrel designs.

SUMMARY OF THE INVENTION

As used herein, "pistol" is used interchangeably with the term "handgun," even though the present invention is not a self-loading, semiautomatic handgun is the strictest definition of a "pistol."

The invention provides a lightweight, small, collapsible, easily concealed pistol which can hold two cartridges. It can also include folding blast shields in front of the user's fingers to absorb recoil, improve grip and protect the user's hand from muzzle blast. The pistol is balanced so that the majority of the weight is concentrated behind the blast shields, resulting in more stability when discharged. It provides a triangulated grip pattern, with one finger above and at least two fingers below the bore of the barrel(s) and against the palm or heel of the user's hand. Additionally, when the pistol is held by a user, the gun bore axis is in close alignment to the center axis of the user's forearm; reducing barrel jump and improving accuracy. The invention's rear activation arm allows the pistol to be fired only when indexed to the full upright position. When the arms are in the folded closed position, the pistol is compact, safe and cannot be discharged. Additionally, the pistol is designed to be operated either with passive aiming or active aiming systems, depending on the user's preference and circumstances. The pistol of this invention is ambidextrous and can be used equally in either the right or left hand.

BRIEF DESCRIPTION OF THE DRAWING

Like reference numerals are used to indicate like parts throughout the various figures of the drawing, wherein.

DETAILED DESCRIPTION OF THE INVENTION

Figure 1:
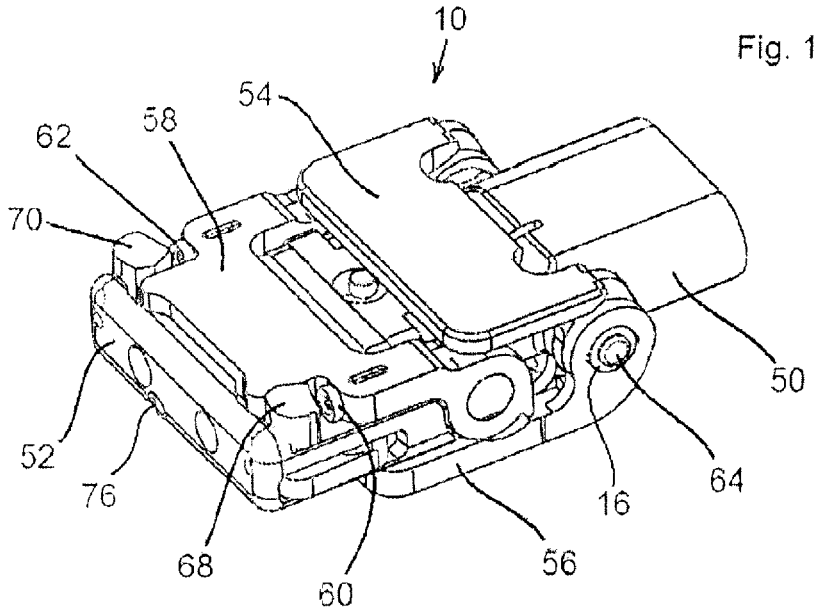
FIG. 1 is an isometric view of a collapsible pistol according to one embodiment of the invention in the closed position.
Figure 2:
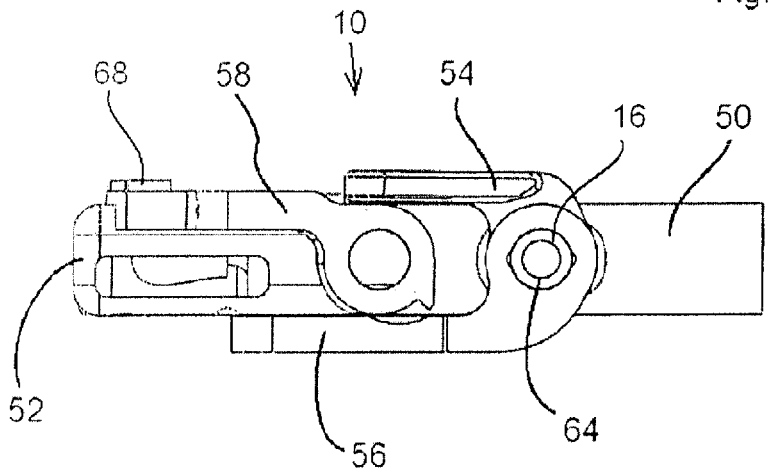
FIG. 2 is a side view of the apparatus in the closed position.
Figure 3:
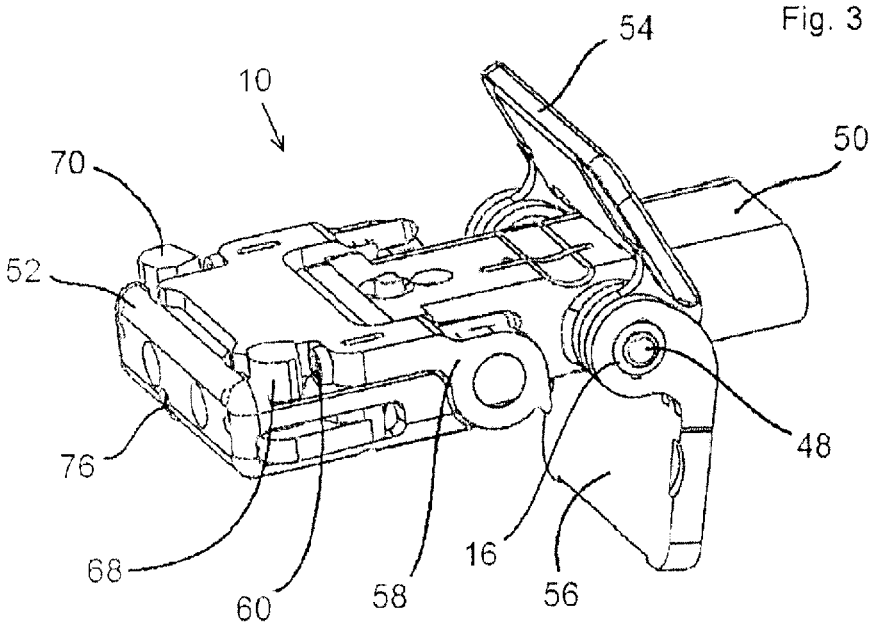
FIG. 3 is an isometric view of the apparatus with front arms deployed.
Figure 4:
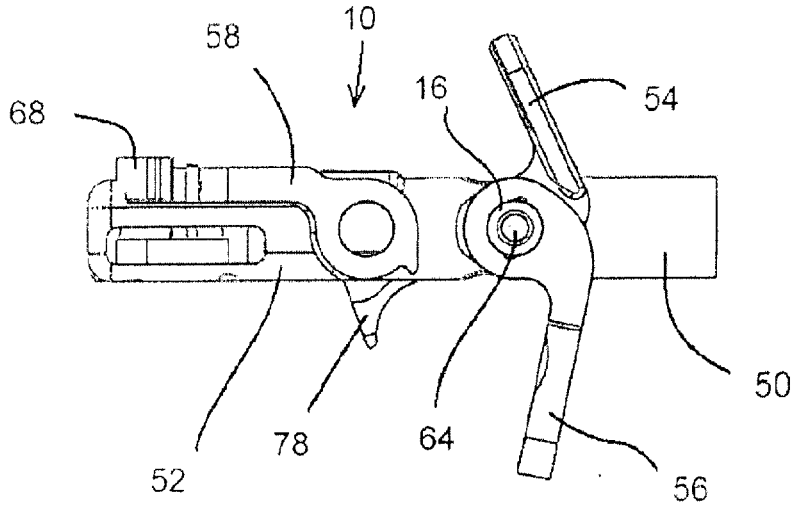
FIG. 4 is a side view with the apparatus's front arm deployed.
Figure 5:
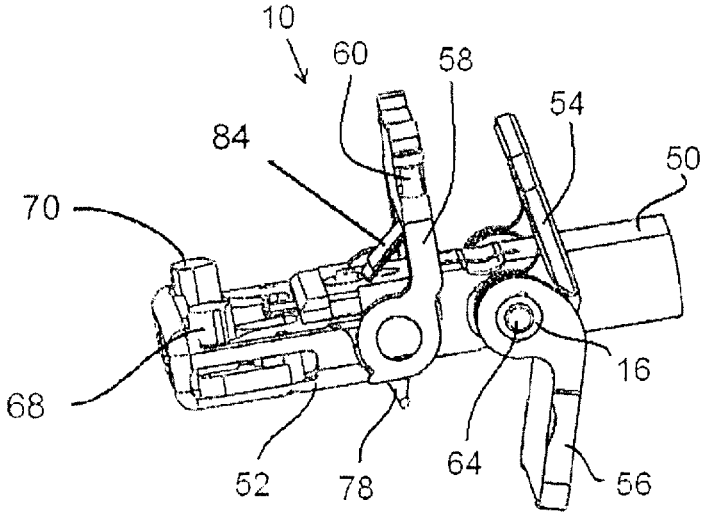
FIG. 5 is an isometric view of the apparatus fully deployed and armed.
Figure 6:
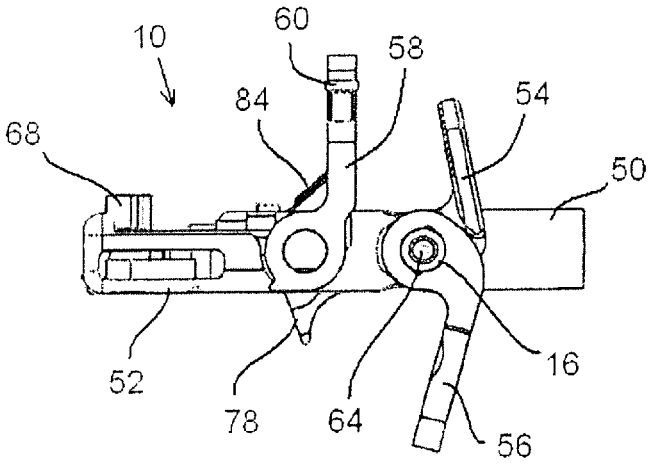
FIG. 6 is a side view of the apparatus fully deployed.

Referring now to the various figures of the drawing and first to FIGS. 1 and 2, therein is shown at 10 a compact pistol according to one embodiment of the invention. FIGS. 1 and 2 show the pistol 10 in a folded, closed position that would be used for storage or while being carried on a person. In this position, the pistol 10 is in a safe mode and cannot be fired. FIGS. 3 and 4 show the pistol 10 in a partially open position, but still in a safe mode, as the rear activation arm 58 is still in the closed position. FIGS. 5 and 6 show the pistol 10 in a fully deployed and ready to fire mode.

Figure 17:
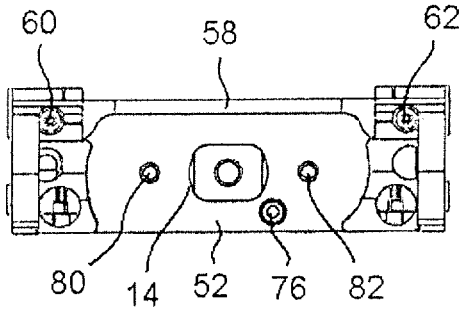
FIG. 17 is a front view of the receiver portion.
Figure 18:
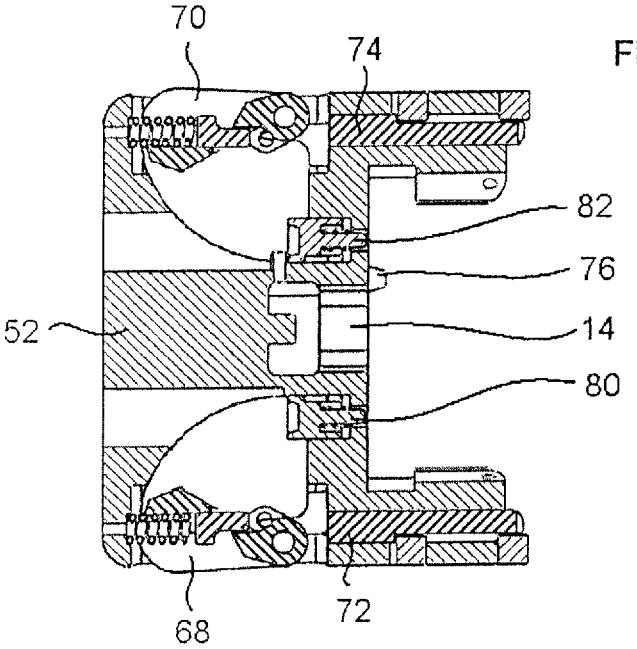
FIG. 18 is a top section view of the receiver portion.

A barrel portion 50, which holds two center fire or rim fire cartridges, is attached to the receiver 52 by a lug 12 that interlocks with a socket 14 in the receiver 52 (shown in FIG. 17). In this embodiment, an optional upper blast shield 54 and optional lower blast shield 56 are rotatably attached to the barrel portion 50 on trunnion lugs 16. The upper and lower blast shields 54, 56 can rotate from a closed position (shown in FIG. 1) to an open position (shown in FIG. 3). After opening the pistol 10 to the position shown in FIG. 3, the user would slide an index finger above the barrel portion 50, behind the upper blast shield 54, and simultaneously slide a middle finger under barrel portion 50 and behind the lower blast shield 56. In this position, the pistol 10 is still in a safe mode, as the rear activation arm 58 is still in the closed position. To bring the pistol 10 to a ready to fire position, the user would raise the rear activation arm 58, as shown in FIGS. 5 and 6, so that an index finger is between the upper blast shield 54 and the rear activation arm 58. In this position, the pistol 10 is ready to fire.

Figure 20:
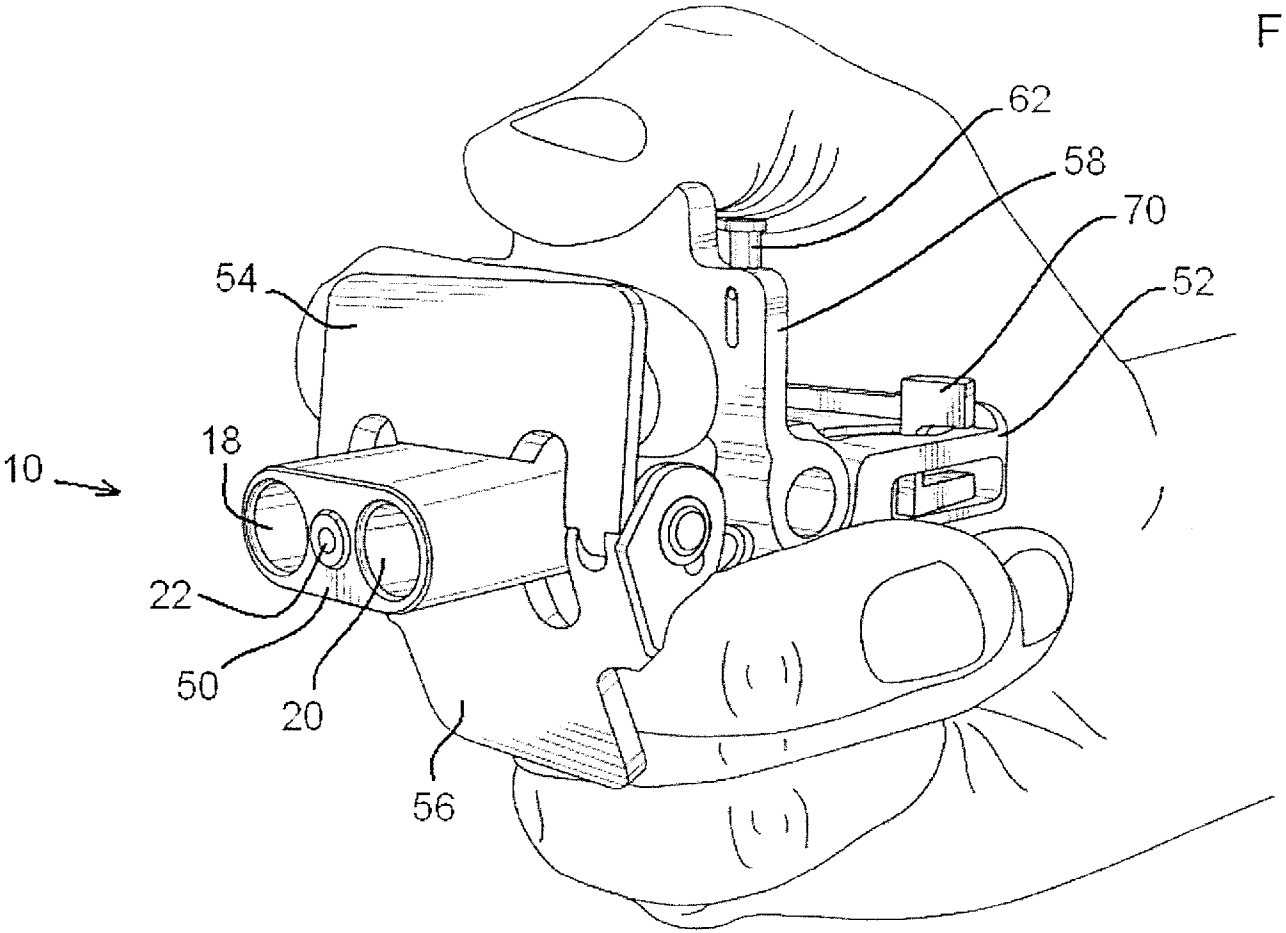
FIG. 20 is a pictorial view of the pistol as held in an in-use position by a user.
Figure 21:
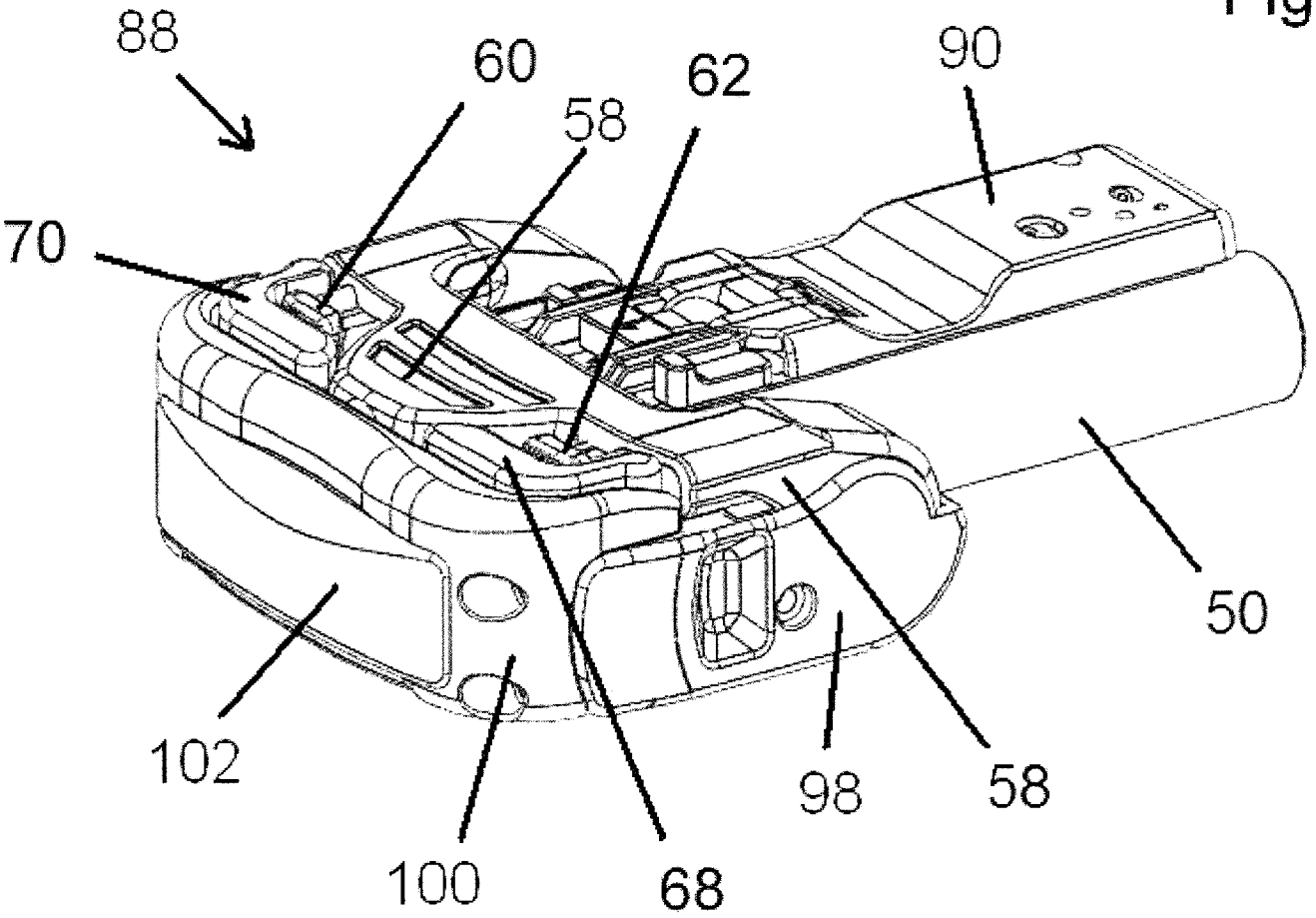
FIG. 21 is an isometric view of a second embodiment of the invention in a closed position.
Figure 22:
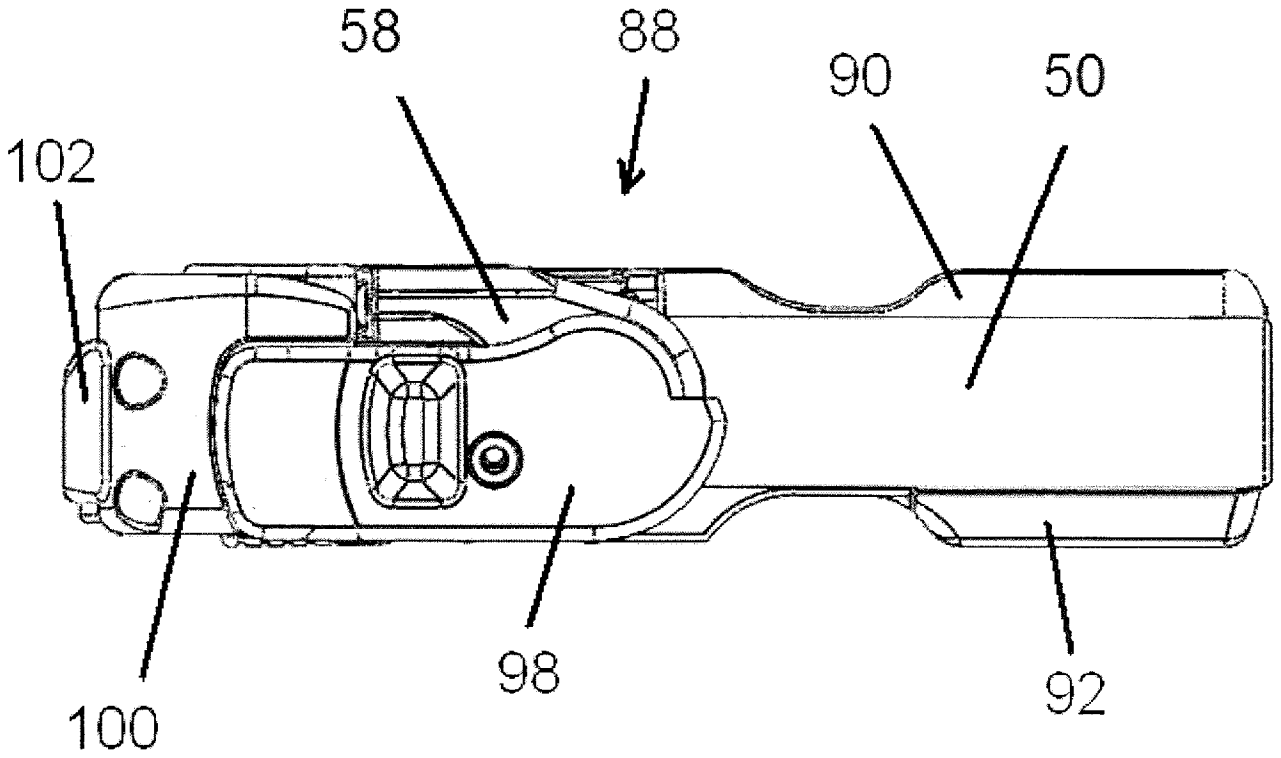
FIG. 22 is a side view thereof in a closed position.
Figure 23:
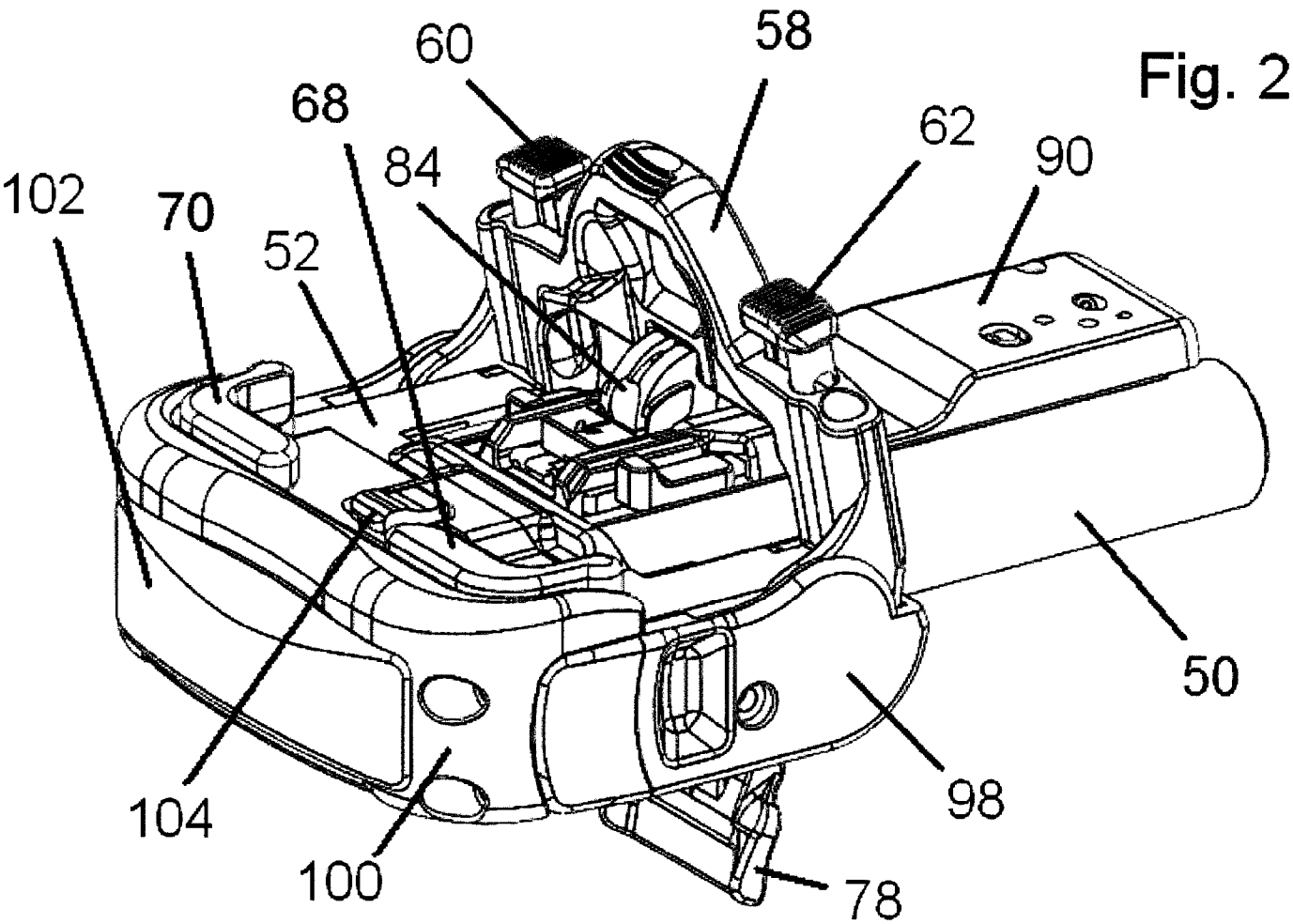
FIG. 23 is an isometric view thereof in a deployed position.
Figure 24:
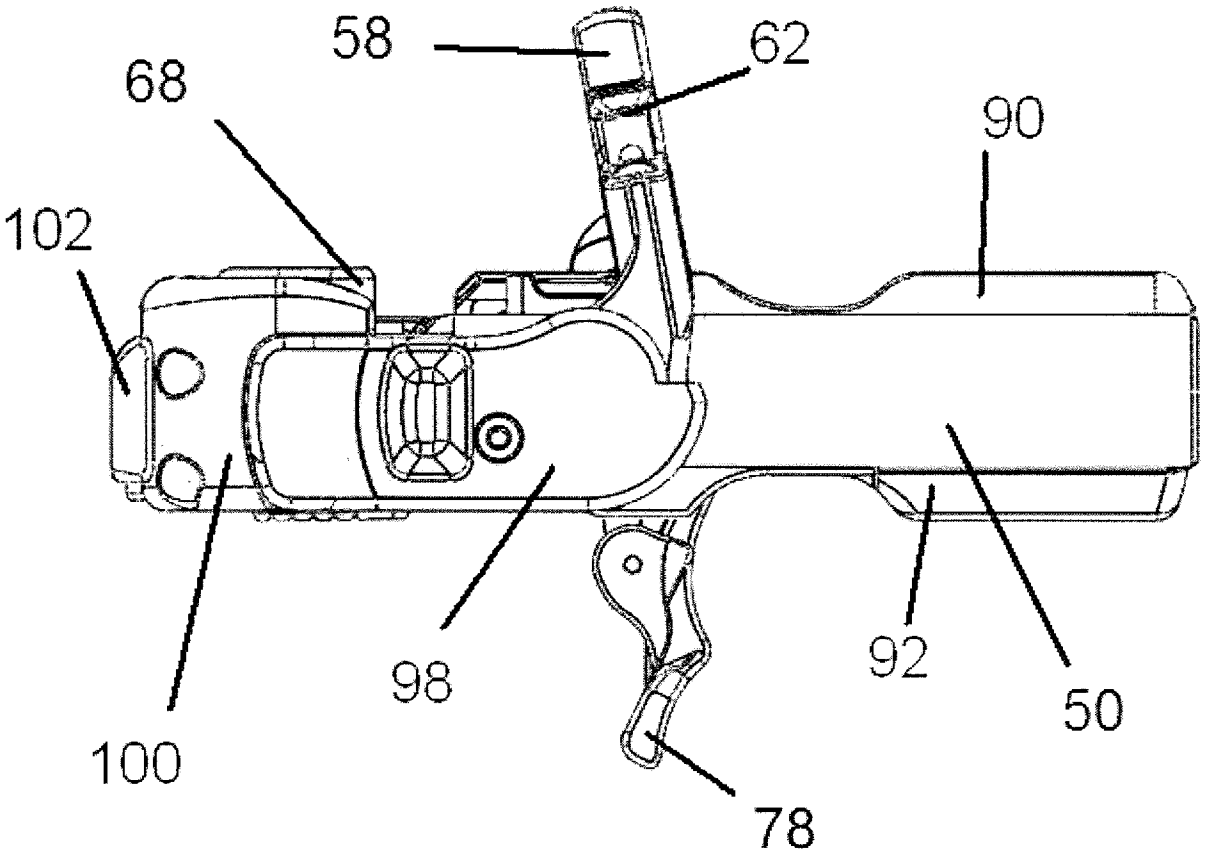
FIG. 24 is a side view thereof in a deployed position.
Figure 25:
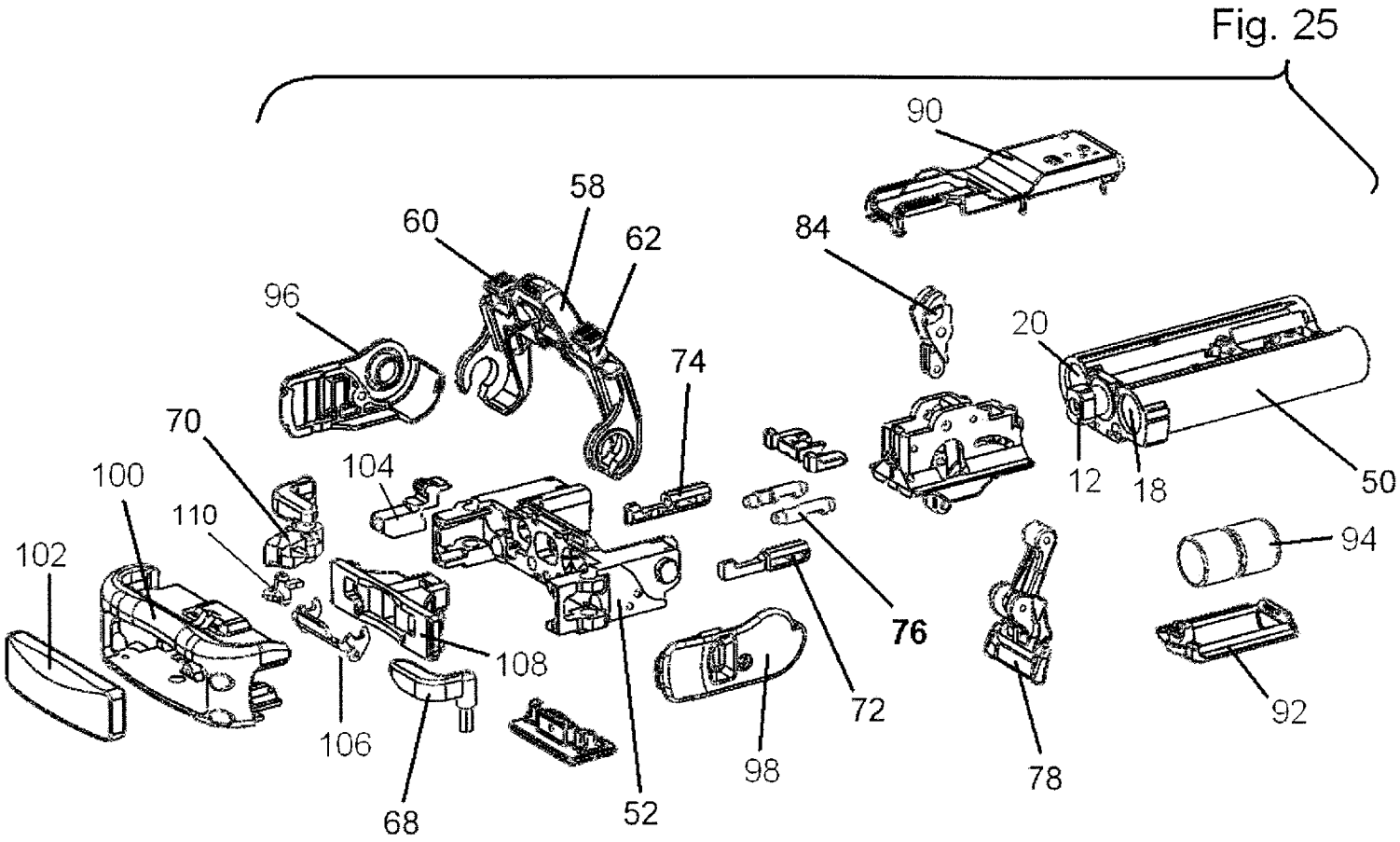
FIG. 25 is an isometric exploded view.

When the pistol 10 is in its fully deployed position, the left trigger 62 may be pushed downward by the user's thumb and the left hammer 70 will be released and driven by spring force to discharge an ammunition cartridge (not shown) in the left chamber/bore 20 of the barrel portion 50. When the right trigger 60 is pushed downward by the user's thumb, it will release the right hammer 68 to discharge an ammunition cartridge (not shown) in the right chamber/bore 18 of the barrel portion 50. The upper blast shield 54 and the lower blast shield 56, in combination with the back of the receiver 52, which is resting on the large thumb muscle group (known as the thenar eminence), transfers the recoil of the pistol 10 when fired, thus allowing a larger caliber bullet (in the illustrated embodiment, a .380 ACP caliber) to be fired out of a small compact gun. This is illustrated in FIG. 20. If the pistol 10 is held without resting the receiver 52 on the large thumb muscle group (known as the thenar eminence), the upper blast shield 54 and lower blast shields 56 would transfer all of the recoil to the user's fingers when discharged.

More specifically, the upper blast shield 54 and lower blast shields 56 are released from their closed position (as in FIG. 1) to the open position (as in FIG. 3) by pushing either of the release buttons 64, 66. Alternatively, the pistol 10 could be configured to require the user to push both the right release button 64 and left release button 66 simultaneously. If desired, the upper blast shield 54, lower blast shield 56, and/or back of the receiver 52 could have a pad of elastomeric material (not shown) installed or inserted on the areas that touch the user's fingers and hand to soften the felt recoil from the pistol 10.

In FIG. 3, the rear activation arm 58 in the closed position and mechanically blocks the right hammer 68 and the left hammer 70 from striking the firing pins 80 and 82. By blocking the hammers 68, 70 in a cocked position, accidental discharge of the pistol 10 is prevented. Because of the aforementioned mechanical safeties, the right trigger 60 and the left trigger 62 could be actuated with very light pressure, possibly 1-3 pounds, instead of the more typical 5-12 pounds found in many revolvers or traditional pistol. The reduced force that is needed to push the trigger 60 or 62 would allow for more accurate shooting, as the pistol is less likely to move off target.

The rear activation arm 58 could be spring loaded and have a mechanical release push-button (not shown) that would prevent the activation arm 58 from opening without the operator pushing the mechanical release push button. When the rear activation arm 58 is in the open position (as in FIG. 5), it can be secured in the full open position by a mechanical lock, such as the rear activation arm lock 84.

Figure 7:
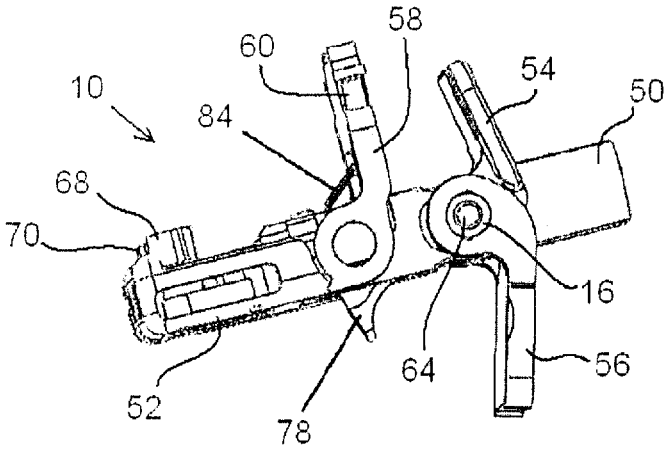
FIG. 7 is an isometric view of the apparatus with the lower grip deployed.
Figure 8:
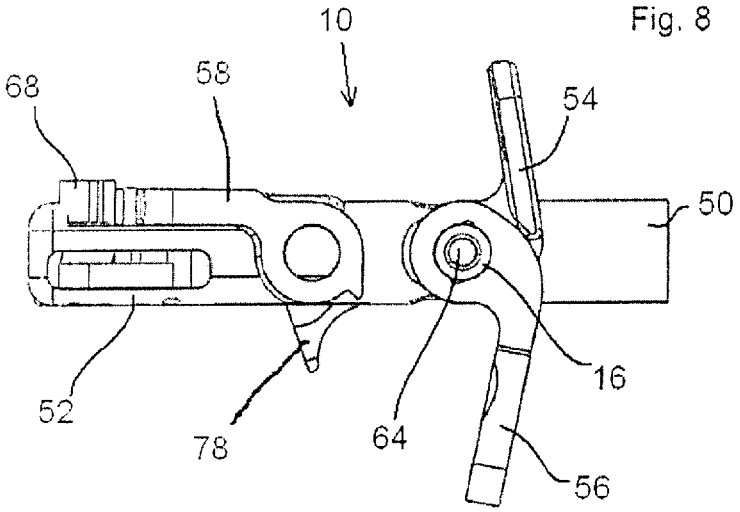
FIG. 8 is a side view of the apparatus with the activation arm in its safe position.
Figure 9:
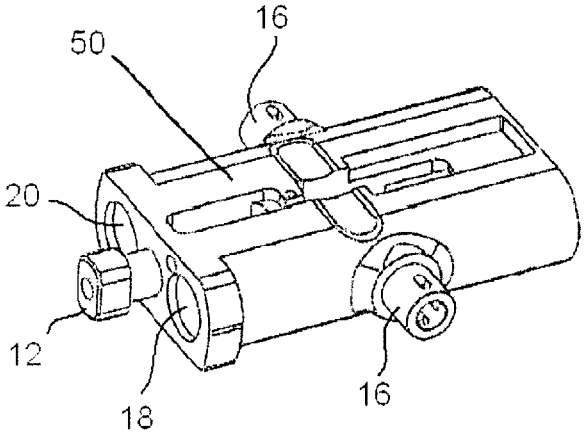
FIG. 9 is an isometric view of the barrel portion.
Figure 10:
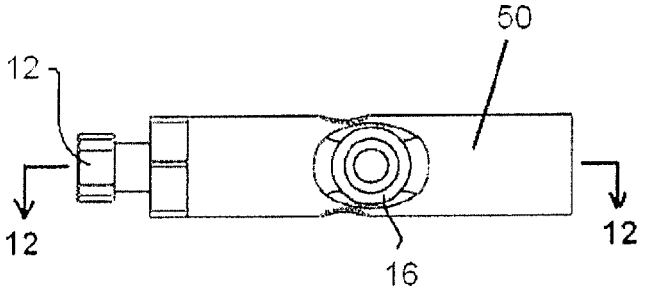
FIG. 10 is a side view of the barrel portion.
Figure 11:
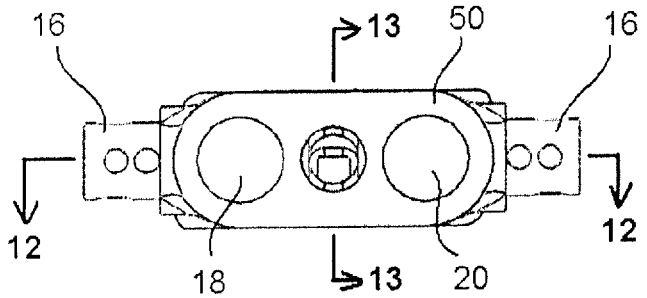
FIG. 11 is a front view of the barrel portion.
Figure 12:
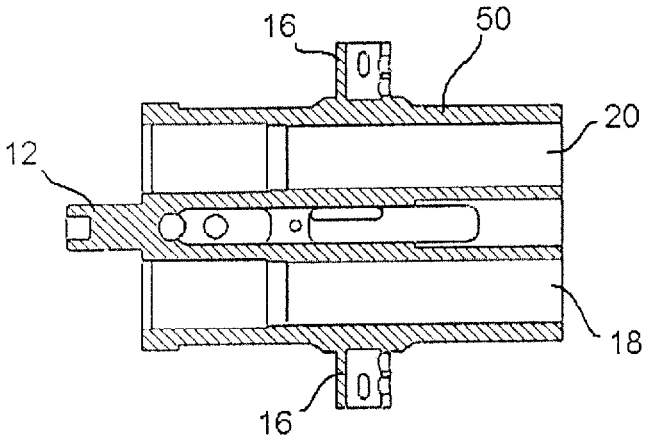
FIG. 12 is a top section view of the barrel portion.
Figure 13:
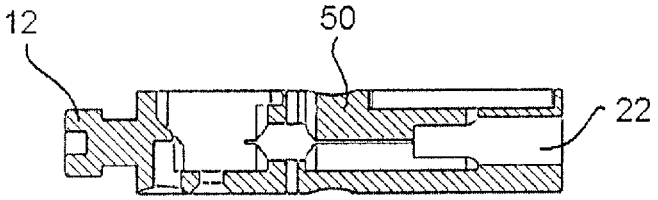
FIG. 13 is side section view of the barrel portion.
Figure 14:
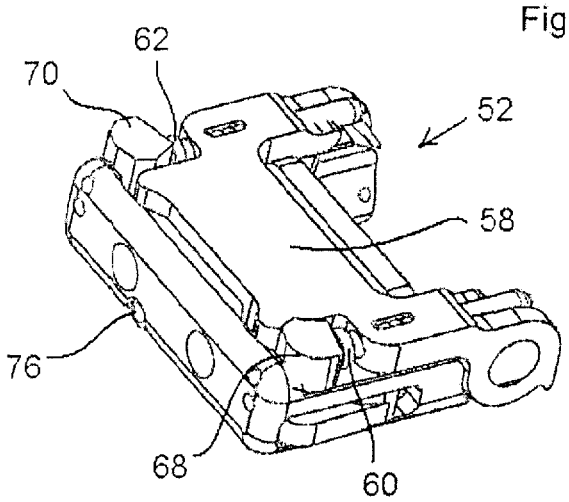
FIG. 14 is an isometric view of the receiver portion.
Figure 15:
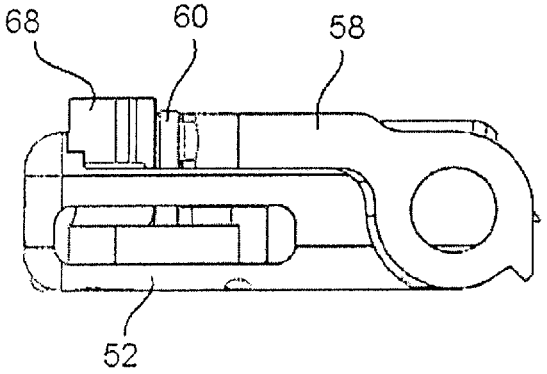
FIG. 15 is a side view of the receiver portion.
Figure 16:
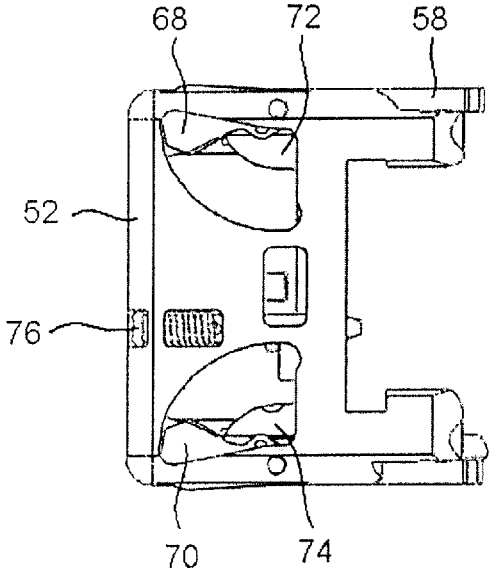
FIG. 16 is a bottom view of the receiver portion.

As shown in FIGS. 5-7, the lower grip 78 can have an extension spring (not shown) attached to it that would force the lower grip 78 to automatically deploy or drop down when the upper blast shield 54 and the lower blast shield 56 are opened. The lower grip 78 allows the user to pull the pistol tight against the large thumb muscle group (the thenar eminence). When the upper blast shield 54 and the lower blast shield 56 are closed, the lower grip 78 is automatically recessed back into the barrel portion 50, as shown in FIG. 2.

Figure 19:
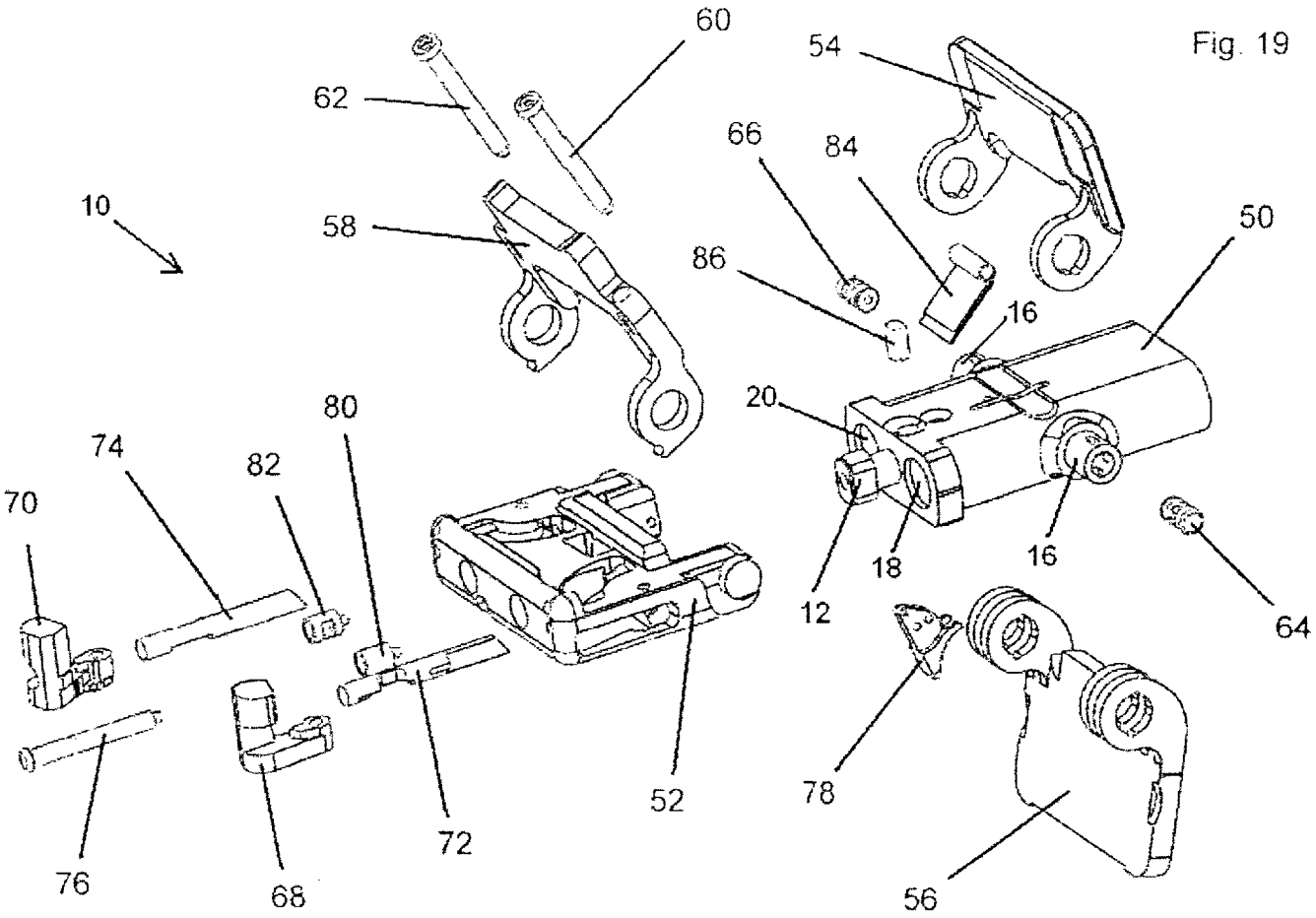
FIG. 19 is an isometric exploded view of the pistol.

Referring now also to FIG. 19, to reload the pistol 10 after a discharge, the user would raise or cock the right hammer 68 (if it was discharged), which would lock in the cocked position by right shear pin 72 (or sear) and raise or cock the left hammer 70 (if it was discharged), which would lock in the cocked position by left shear pin 74 (or sear). The user would then lower the activation arm 58, then release anti-rotate pin 76, which would allow the receiver 52 to be rotated 90 degrees, which would then allow the receiver 52 to be pulled away and/or separated from the barrel portion 50. In this condition, the user can remove the spent shell casing (not shown) and reload. To reassemble, the user would then push the receiver 52 back onto the barrel portion 50 and rotate it back until the anti-rotate pin 76 engages and locks the receiver 52 and the barrel portion 50 into the correct alignment.

If desired, a laser aiming device 22 (see FIG. 20) can be housed in the barrel portion 50 between the right and left bores 18, 20. This space may also house a forwardly-directed light (not shown), if desired. As shown in FIG. 20, the pistol is held with a triangulated grip: fingers above and below the barrel/receiver 50/52 and firmly against the user's palm. Moreover, the barrel bores 18, 20 are substantially axially aligned with the user's extended forearm, as shown in FIG. 20.

The barrel portion 50 may be made of any suitable material, such as stainless steel, in combination with any other suitable material, including resin/fiber composites. The receiver 52 may be made of any suitable material, such as stainless steel, in combination with any other suitable material, including composites. The blast shields 54 and 56 may be made of any suitable material, such as stainless steel, in combination with any other suitable material, including composites or a polymer, such as glass filled nylon, so they could more easily be covered in an elastomeric material or made by a multishot injection molding process. The activation arm 58 may be made of any suitable material, such as stainless steel, in combination with any other suitable material, including composites. The triggers 60 and 62 may be made of any suitable material, such as stainless steel, in combination with any other suitable material, including composites. The hammers 68 and 70 may be made of any suitable material, such as stainless steel, in combination with any other suitable material, including composites. The shear pins 72 and 74 may be made of any suitable material, such as stainless steel, in combination with any other suitable material, including composites. The remaining parts may be made of any suitable material, such as stainless steel, in combination with any other suitable material, including composites.

Referring now to FIGS. 21-25, therein is shown at 88 a folding pistol according to an alternate embodiment of the invention. This embodiment omits the optional blast shields 54, 64 (and trunnion lugs 16) shown in the pistol 10 of FIGS. 1-20, but otherwise operates in much the same way as the pistol 10 described above. The barrel 50 is rotatably and removably attached to the receiver 52 by a lug 12. Upper and lower covers 90, 92 attach to the barrel 50 to enclose a laser sighting device and/or forward light source (not shown) and battery 94 between the bores 18, 20 of the barrel 50.

In this embodiment, the lower grip 78 is extended in length to provide additional stability and contact with an additional finger of the user's hand. The pistol 88 is deployed (FIGS. 23 and 24), folded (FIGS. 21 and 22), loaded, and fired in a similar manner to the first embodiment 10. The receiver 52 may include left and right side covers 96, 98 and a rear cover 100. A latch 104 is displaced to allow the activation arm 58 and lower grip 78 to deploy. Mounted in the rear receiver cover 100 may a cushion or pad 102 positioned to bear against the user's palm, as described below.

The pistol 88 includes similar safety features that block the hammers 68, 70 and/or sear pins 76 to render the triggers 60, 62 inoperable. The pistol 88 may include an optional grip safety. Depressing the pad 102 by pressing the pistol 88 against the palm can pivotally displace a lever arm 106 mounted in a secondary receiver member 108. Pivotal displacement of the lever arm 106, in turn, causes a sear block 110 associated with each sear pin 76 to move out of blocking interference with movement of the sear pins 76 and/or hammers 68, 70. Thus, not only do the activation arm 58 and lower grip 78 have to be deployed before the pistol 88 can be fired, optionally the pad 102 must be depressed by properly and securely gripping the pistol 88 against the palm.

While the foregoing written description of the invention enables one of ordinary skill to make and use what is considered presently to be the preferred mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention, as set forth in any claim or claim issuing herefrom.

What we claim is:

1. A collapsible pistol, comprising:

a barrel assembly including at least one chamber and at least one barrel bore;

a receiver assembly configured to operably attach to the barrel assembly, the receiver assembly including a body, at least one hammer, and at least one sear; and an activation arm pivotally attached to the receiver body to move between folded and deployed positions, the activation arm carrying at least one trigger, the trigger being operable to release the sear when the activation arm is in the deployed position and inoperable when the activation arm is in the folded position, further comprising a finger grip attached to and extendable from the receiver body substantially opposite the activation arm.

2. The collapsible pistol of claim 1, wherein the barrel includes two chambers and two barrel bores, the receiver includes two hammers and two sears, and the activation arm includes two triggers.

3. A collapsible pistol, comprising:

a barrel assembly including at least one chamber and at least one barrel bore;

a receiver assembly configured to operably attach to the barrel assembly, the receiver assembly including a body, at least one hammer, and at least one sear; and an activation arm pivotally attached to the receiver body to move between folded and deployed positions, the activation arm carrying at least one trigger, the trigger being operable to release the sear when the activation arm is in the deployed position and inoperable when the activation arm is in the folded position, further comprising a palm safety member that must be depressed while the activation arm is in the deployed position to allow firing actuation by the trigger.

4. The collapsible pistol of claim 3, wherein the barrel includes two chambers and two barrel bores, the receiver includes two hammers and two sears, and the activation arm includes two triggers.

5. A collapsible pistol, comprising:

a barrel assembly including at least one chamber and at least one barrel bore;

a receiver assembly configured to operably attach to the barrel assembly, the receiver assembly including a body, at least one hammer, and at least one sear; and an activation arm pivotally attached to the receiver body to move between folded and deployed positions, the activation arm carrying at least one trigger, the trigger being operable to release the sear when the activation arm is in the deployed position and inoperable when the activation arm is in the folded position, wherein the barrel assembly and receiver assembly are pivotally connected for relative movement along an axis substantially parallel to the barrel bore between a closed position in which the pistol may be operable and an open position in which the chamber may be loaded and unloaded.

6. The collapsible pistol of claim 5, wherein the barrel includes two chambers and two barrel bores, the receiver includes two hammers and two sears, and the activation arm includes two triggers.

* * * * *